United States Patent [19]

Schmidt

[11] Patent Number: 4,525,411

[45] Date of Patent: Jun. 25, 1985

[54] CLEANING CLOTH

[75] Inventor: Klaus Schmidt, Kaiserslautern, Fed. Rep. of Germany

[73] Assignee: Firma Carl Freudenberg, Weinheim, Fed. Rep. of Germany

[21] Appl. No.: 630,348

[22] Filed: Jul. 13, 1984

Related U.S. Application Data

[63] Continuation of Ser. No. 302,572, Sep. 15, 1981, abandoned.

[30] Foreign Application Priority Data

Sep. 15, 1980 [EP] European Pat. Off. ..... 80105

[51] Int. Cl.[3] ..... B32B 27/14

[52] U.S. Cl. ..... 428/198; 15/209 R; 428/195; 428/288; 428/296; 428/369; 428/373; 428/392; 428/397; 428/412; 428/903

[58] Field of Search ..... 428/198, 288, 296, 373, 428/392, 397, 903, 412, 195, 369; 15/208, 209 R, 215

[56] References Cited

U.S. PATENT DOCUMENTS

| | | | |
|---|---|---|---|
| 2,972,554 | 2/1961 | Muskat et al. | 428/361 |
| 3,483,069 | 12/1969 | Cairns et al. | 428/903 |
| 3,542,634 | 11/1970 | Such et al. | 428/198 |
| 3,546,063 | 12/1970 | Breen | 428/903 |
| 4,298,649 | 11/1981 | Meitner | 428/198 |
| 4,307,143 | 12/1981 | Meitner | 428/198 |
| 4,436,780 | 3/1984 | Hotchkiss et al. | 15/209 R |

*Primary Examiner*—James J. Bell

*Attorney, Agent, or Firm*—Kenyon & Kenyon

[57] ABSTRACT

A cleaning cloth is described which is made from microfibers having a nonporous fiber core surrounded by a foamed coating layer containing open celled pores. The microfibers may optionally be combined with other types of fibers. The cloth has a high capacity for holding dirt and in another application, a detergent, bacteriocide, fungicide or preservative can be contained in the pores to provide a combination cleaning cloth.

16 Claims, 2 Drawing Figures

CLEANING CLOTH

This application is a continuation of application Ser. No. 302,572, filed Sept. 15, 1981 abandoned.

BACKGROUND OF THE INVENTION

The invention relates to a cleaning cloth containing porous fibers.

Development of a cleaning cloth is desired which will separate dirt from the surface of an article to be cleaned and to store the dirt in the interior of the cloth fibers. The storage capacity depends essentially on the pore volume contained therein and many attempts have been made to optimize the capacity. One possibility utilized in this respect is the use of naturally grown fibers because they have high pore cavity content. Such fibers, however, are relatively fragile and after a brief use, fiber components are separated which are deposited in the form of dust-like particles or lint on the surface to be cleaned.

Therefore, it is an object of the invention to develop a high pore capacity cleaning cloth which no longer has this disadvantage.

SUMMARY OF THE INVENTION

This and other objects are achieved by the invention, which is directed to a cleaning cloth which stores dirt in its interior. The cloth accomplishes this effect because it is made from porous fibers which are microfibers of a polymeric composition, and have an essentially nonporous fiber core surrounded by a foamed coating layer containing open cell pores. The microfibers may be mixed and/or covered up with fibers of a different type and are cemented together with chemical binder or are autogenously bonded.

BRIEF DESCRIPTION OF THE DRAWINGS

The drawings depict an example of the cleaning cloth according to the invention.

DETAILED DESCRIPTION OF THE INVENTION

Figure 1:
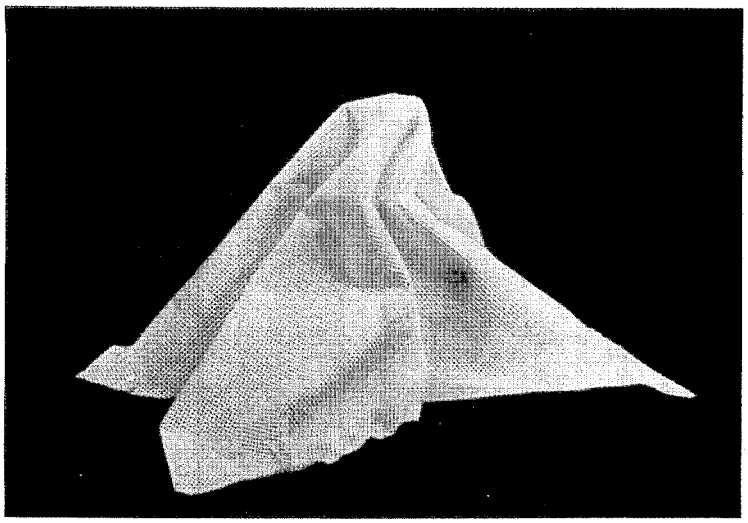
FIG. 1 shows a drapable embodiment of the cleaning cloth on a scale 1 to 4.
Figure 2:
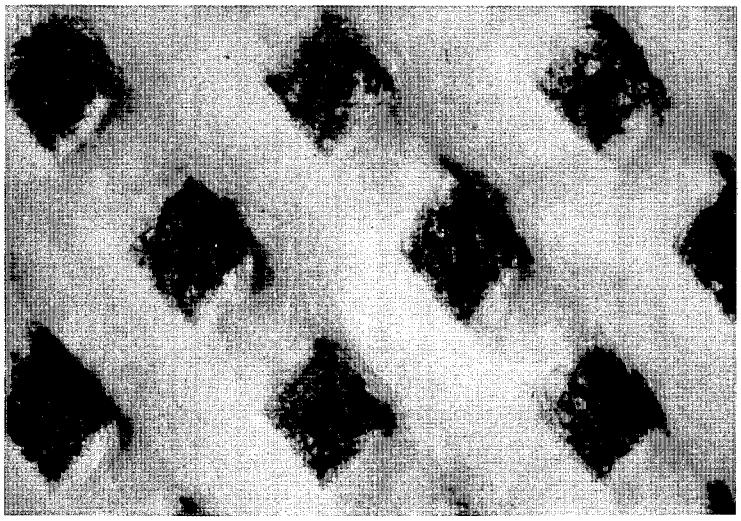
FIG. 2, scale 1 to 20, shows a fibrous fabric with very fine fibers, which is covered on both sides by a thin nonwoven fabric and is bonded by spot fusing. The fibers of the thin cover fabrics are bonded into the fused or bonded areas formed thereby. The penetration of the layer of very fine fibers through the openings between the fibers of the cover fabric can be seen clearly.

The cleaning cloth microfibers having a nonporous fiber core and a foamed coating layer surrounding the core as well as the process to make them are described in applicant's copending application entitled "Electrostatic Formed Fiber of Polymer Material" which was filed on the same data as the present application and is incorporated herein by reference.

These microfibers may be used alone or may be combined with other types of fibers to produce the cleaning cloth of the invention. The other fibers may comprise the same polymer material as the microfibers, which may have advantages in a physiologically sense and/or with respect to resistance against aggressive cleaning fluids. In another embodiment, in which the microfibers and the other fibers are made from different polymers, an advantage is that the mechanical properties of the cleaning cloth can be modified over a larger range. In this manner, effective abrasion resistance, in particular, can be combined with high flexibility.

When combining fibers of different types of polymers, the use of a fiber mixture has been found to be particularly advantageous, in which the microfibers are polycarbonate and the fibers of the other type are polyamide, polypropylene or cellulose wool.

For any combination with other fibers or for use alone, the microfibers have preferably a ribbon-shaped profile which is comparable to that of a horizontal figure-eight. The ratio of the greatest width of such a profile and the greatest thickness is in the range of about 2.5 to 5. Due to the predominantly flat arrangement of the profile of these fibers within the cleaning cloth, their abrasion resistance is relatively high, which has a positive effect on the overall abrasion resistance. The largest diameter circumscribing this profile may be from about 1 to 20 microns.

Microfibers are preferred in which the molecular structure has been given at least a partial directional orientation through a preparative stretching process. The tensile strength of such microfibers is higher than that of comparable microfibers with an amorphous molecular structure.

Fibers of the other type for use in the fiber mixture can be synthetic staple fibers or endless fibers preferably with a wrinkled texture. Commericially available grades are suitable. Preferably, these fibers are chosen so that their diameter is 5 to 20—times larger than the largest diameter of the microfibers. A uniform mixture of both types of fibers produces improved spring elasticity and increased fullness with improved dirt absorption capacity. Optimum propeties in this regard are obtained by a combination with wrinkled staple fibers.

These staple fibers or endless fibers may comprise a polymer composition which has a lower melting point than that of the polymer making up the microfibers. With this arrangement, a suitable fabric can be produced simply by spot fusing. The cleaning cloth is then made by compressing the fabric along lines forming a grid pattern and heated to a temperature above the softening point of the staple fibers or endless fibers. These fibers are completely fused along the compression lines and typically form areas of window-like appearance within which the microfibers, the shape of which is completely unchanged, are bonded. Appropriate spot fusion can be realized on a technically large scale by using a heated calender, the cylinders of which have suitable surface engraving. For a cleaning cloth with an area weight of 120 g/m,$^2$ the individual spot fusions can have a diameter of 0.3 mm and a mutual spacing of 1.2 to 2.8 mm. However, the bonding can also be performed with ultrasound or high frequency particle waves. In the spaces between the fused surfaces, the fibers lie loosely on each other without mutual bonding. Accordingly they are movable in these areas, and dirt to be absorbed is readily transported into the interior of the cleaning cloth.

Through the arrangement of a separate layer of staple or endless fibers on the surfaces of the cleaning cloth, greater mechanical resistance, especially to abrasion, is obtained. Of course, such a staple or endless fiber covering must have a relatively low density.

According to another embodiment, a detergent, a wetting agent, a bacteriocide and/or a fungicide and/or a preservative is absorbed into the pores of the foamed, open cell coating layer of the microfibers. The pores of the microfibers extend substantially perpendicularly to the surface, and they have predominantly cylindrical shape and uniform distribution. Due to their small size, they are not compressible and an agent embedded therein cannot be removed from the pores by a mechanical process, but only through the action of a solvent, such as water. According to the invention, this effect is utilized for a substantial expansion and improvement of the use properties, by absorbing the foregoing types of agents into the pores. The effect obtained is long-term, although it may be limited by the natural wear. A similarly uniform, economical application of such agents has not been possible heretofore under conditions which prevail in a normal household.

Typically, the pores of the microfibers for cleaning cloth and agent absorption have a diameter of 0.01 to 0.5 microns and preferably of 0.05 to 0.2 microns. The total cross sectional pore area covers 1 to 95%, and preferably 10 to 70% of the foamed coating cross sectional area. The foamed layer, which contains the pores, is clearly delineated from the pore-free fiber core and the pores cover 40 to 80% and preferably 60% of the entire cross sectional area of the fiber. The storage volume obtained is accordingly considerable.

The non-woven fabric structure of the cleaning cloth of the invention can also be stablized by a binder which is absorbed and/or applied by impregnating and/or printing. Binders are used preferably which consist of a foamed soft plastic, for instance, a polyurethane or latex foam. If a printing process is used, the binder may be distributed in a pattern on one or both surfaces. In the former application, the advantage is obtained that coarse dirt can first be removed with the printed side of the cleaning cloth, which is partially absorbed by the interspaces. The cloth is subsequently turned over and the cleaning process is finished by using the unprinted front side of the cleaning cloth. High effectiveness is achieved by using the printed side, expecially when the binder printed on the surface of the cleaning cloth extends beyond the surface in relief-fashion, and when the individual binder of the cloth areas are sharply delineated, and are not wider than 2 or 3 mm. The ratio of the mutual spacings between individual binder areas and the width of these partial areas, should not exceed 5. In one attractive design, the partial binder areas can form capital letters which are related to each other by the foregoing requirements.

What is claimed is:

1. A cleaning cloth, which comprises: a fabric of intermingled fibers, said fibers being bonded to each other at a substantial number of interfiber junctions and at least some of said fibers being porous microfibers of a polymeric composition, each microfiber comprising a core of substantially nonporous polymer and a foamed polymer cover layer which surrounds said core, has a sheath-like configuration around said core, is coaxial with said core and contains open micropores, said micropores having a predominantly cylindrical shape, being substantially uniformly distributed within the sheath-like cover layer, encompassing from about 40 to 80% of the cross sectional area of each microfiber and the long axes of the pores being disposed parallel to the microfiber cross-sectional radius.

2. A cleaning cloth according to claim 1 wherein synthetic stable or continuous fibers, which are heavily crimped, are admixed with or cover the microfibers.

3. A cleaning cloth according to claim 1 wherein said fibers are bonded by a chemical binder.

4. A cleaning cloth according to claim 3 wherein said chemical binder is polyurethane or latx foam.

5. A cleaning cloth according to claim 3 wherein the distribution of said chemical binder among said fibers has been accomplished by patterned application of said binder onto said fabric.

6. A cleaning cloth according to claim 5 wherein said binder is at least in part present as a printed partial coating on the surface of said fabric, said coating being at least in part raised in relief-fashion above said surface.

7. A cleaning cloth according to claim 1 wherein said fibers are autogenously bonded.

8. A cleaning cloth according to claim 1, wherein said micropores contain a detergent, a wetting agent, a bacteriocide a fungicide, a preservative or a mixture thereof.

9. A cleaning cloth according to claim 1 wherein said cover layer is coaxial and concentric with said core.

10. A cleaning cloth according to claim 1 wherein said microfibers have a ribbon-shaped profile in cross-section, which is substantially comparable in shape to a figure eight, said cover layer and said core each having said ribbon-shaped profile and said cover layer substantially uniformly surrounding said core.

11. A cleaning cloth according to claim 10 wherein the ratio of the greatest width to the greatest thickness of said microfiber ribbon-shaped profile is within a range of from 2.5 to 5.

12. A cleaning cloth according to claim 11 wherein the diameter of a circle circumscribing said ribbon-shaped profile is from about 1 to 20 microns.

13. A cleaning cloth according to claim 1 wherein said fibers are substantially all microfibers.

14. A cleaning cloth according to claim 1 wherein polyamide, polypropylene or cellulose wool fibers are substantially uniformly admixed with said microfibers.

15. A cleaning cloth according to claim 14 wherein the diameter of said polyamide, polypropylene or cellulosic wool fibers is from about 5 to 20 times larger than the largest diameter of said microfibers.

16. A cleaning cloth according to claim 1 wherein said microfibers are polycarbonate.

* * * * *